US005104521A

United States Patent [19]

Rutherford

[11] Patent Number: 5,104,521

[45] Date of Patent: Apr. 14, 1992

[54] MODULAR TENSIONED SCREEN SURFACES

[75] Inventor: William Rutherford, Islington, Australia

[73] Assignee: Floris Pty Ltd., Islington, Australia

[21] Appl. No.: 628,452

[22] Filed: Dec. 14, 1990

[30] Foreign Application Priority Data

Dec. 18, 1989 [AU] Australia ..... PJ7897

[51] Int. Cl.[5] ..... B07B 1/46

[52] U.S. Cl. ..... 209/399; 209/405; 209/409

[58] Field of Search ..... 209/397, 399, 405, 409, 209/412, 403, 395, 374, 375, 401, 402

[56] References Cited

U.S. PATENT DOCUMENTS

| | | | |
|---|---|---|---|
| 2,235,653 | 3/1941 | Soldan | 209/401 |
| 3,970,550 | 7/1976 | Fry et al. | 209/399 |
| 4,120,784 | 10/1978 | Hassall | 209/399 |
| 4,137,157 | 1/1979 | Deister et al. | 209/405 X |
| 4,141,821 | 2/1979 | Wolff | 209/395 X |
| 4,661,245 | 4/1987 | Rutherford et al. | 209/399 |
| 4,857,176 | 8/1989 | Derrich et al. | 209/393 X |
| 4,882,044 | 11/1989 | Freissle | 209/399 X |

FOREIGN PATENT DOCUMENTS

| | | | |
|---|---|---|---|
| 2461237 | 3/1978 | Fed. Rep. of Germany | 209/399 |

*Primary Examiner*—Donald T. Hajec

*Attorney, Agent, or Firm*—Hopgood, Calimafde, Kalil, Blaustein & Judlowe

[57] ABSTRACT

The invention relates to ore screening machines having longitudinal bucker bars 17 spaced transversely across a screen box with transverse rails 1 spaced longitudinally along the screen box and supported on bucker bars. The transverse rails have a tension member 5 embedded therein which is connected to a C-shaped connecting member 6 at each end thereof. The C-shaped connecting members connect with hook members 7 which in turn connect with a clamp 9 which is secured to each side wall 14 of the screen box to apply tension to tension member 5. The bucker bars and transverse bars forming a grid structure to support screen modules 18 seated on the transverse rails 1 to provide a screen mat extending across the screen box.

8 Claims, 8 Drawing Sheets

V
5
6
12
8
14
15

1
5
4
22

MODULAR TENSIONED SCREEN SURFACES

This invention relates to tension screen mats for use in ore screening machines.

Such mats are usually moulded from polyurethane and are formed with an array of holes passing through the mat and through which ore particles up to a particular size can pass.

According to one known method the mats are of such size as to extend across the screen box of a screening machine, tensioning cables, wires or rods are embedded in the mat during manufacture and extend transversely across the box when the mat is positioned therein. The mat is supported on spaced longitudinal rails positioned in the box below the mat and clamping means are provided to clamp the mat with the side walls of the box whereby the mat is locked in position and tensioned transversely.

With the use of tension mats only, longitudinal bucker bars are necessary and the use of transverse rails is avoided with a consequent saving in cost, however, as the mat is in one piece and extends across the width of the machine, difficulty is encountered in accommodating any variation in the horizontal positioning of the mat. Additionally if the mat becomes worn or damaged in certain places the whole mat has to be replaced. Mats of this type are costly and the replacement of damaged mats is extremely expensive.

According to another known method the mat is formed of a series of modules supported on an underlying grid-like support structure which includes longitudinal and transverse rails.

The use of modules has overcome the problem of replacing the whole mat where only part of it is damaged, however, the underlying grid-like structure has to be sufficiently strong to support the modules and all the bodies thereon. As stated it includes both longitudinal and transverse rails which add to the cost of the structure and difficulty is still experienced in accommodating any variation in the horizontal angular relationship of the machine.

The invention comprises a tension screen mat system for a screening machine which overcomes the problems associated with those currently in use, which is of robust construction easy to install and service, and which will enable the mat to more clearly follow the contour of the machine than has been possible hitherto.

Accordingly the invention resides in a screening machines including a screen box having longitudinal bucker bars spaced transversely therealong, transverse rails longitudinally spaced along the box and supported on the bucker bars, said transverse rails having tensioning means to tension the transverse rails across said box the transverse rails defining with the bucker bars a grid like structure extending across said box, the transverse rails having a channel along the upper surface thereof co-operating with interengaging means on screen modules seated thereon to detachably secure a module to said transverse rails, said modules forming a screen mat extending across the box.

The invention also comprises a screening machine including a screen box said box having a support member extending longitudinally along said box with longitudinally extending bucker bars transversely spaced along the box on either side of the support member, transverse rails longitudinally spaced along said box on either side of said support member and supported by said bucker bars, the transverse rails on one side of the support member being aligned with the transverse rails on the other side of said support member, said transverse rails having tensioning means to tension said rails across said box between the side walls of said box and said support member, the transverse rails defined with the bucker bars grid like structure extending across said box, the transverse rails having a channel extending along the upper surface thereof and co-operating with interengaging means on screen modules seated thereon to detachably secure said module to said transverse rails, said modules forming a screen mat extending across the box.

Preferably each module has a peripheral portion defined by side and end walls with a plurality of openings extending there through inwardly of the peripheral portion; opposed longitudinal ends of each module being provided with said interengaging means to detachably lock said wall to said transverse rails and opposed ends of each module being provided with interengaging means to connect adjoining modules together.

Preferably the openings through the walls are formed in an array which exends at an angle to the longitudinal axes of the wall.

An embodiment of the invention will now be described with reference to the accompanying drawings in which.

Figure 1:
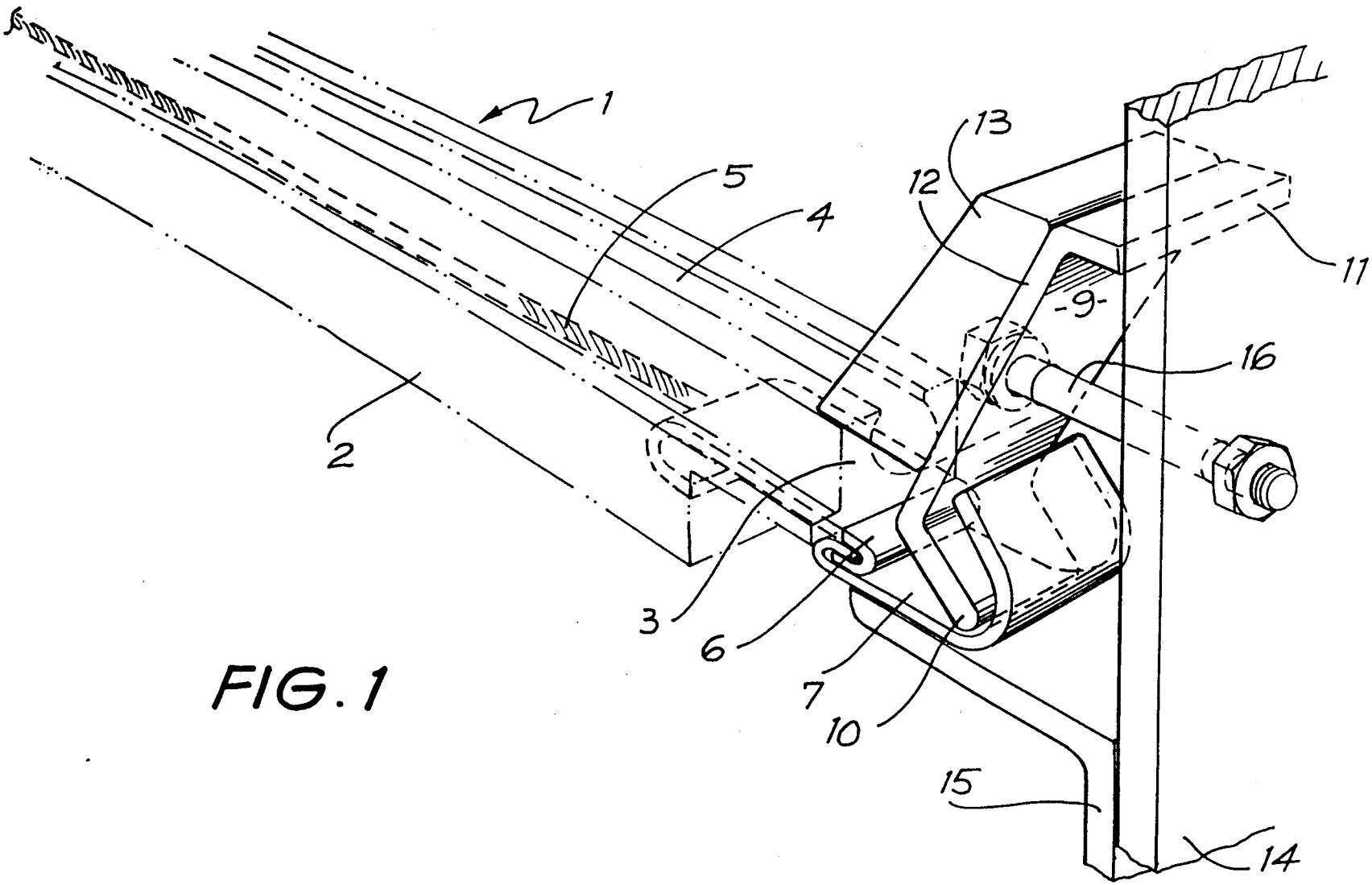
FIG. 1 is a part perspective view showing the transverse rails and the method of attachment to the side walls of the screen box of a screening machine.

Referring now to the drawings, the transverse rail 1 comprises an elongate member having a body portion 2, and an upstanding central rib 3 the rib is provided with a semi-circular shaped channel 4 which extends through its length. The central rib 3 extends beyond each end of the body portion 2 as illustrated in FIG. 1.

The rail 1 is preferably made from polyurethane and embedded within the polyurethane is a tension member 5 which is fixed to a "C" shaped connecting member 6 at each end.

Each of the members 6 engage with a hook member 7. The member 7 is bent at one end to interconnect with the member 6 and is formed with an enlarged hook 8 at its free end which is adapted to engage with a clamp 9 on each side of the machine box.

The clamp 9 has two limbs 10 and 11 connected by a bight portion 12 and a shield member 13 extends from the back face of the bight portion 12.

The side walls 14 of the machine box are provided with flange members 15 which constitute seats to support the member 7. The clamp 9 is secured to the wall 14 by a bolt 16 passing through the bight portion 12.

It will be appreciated that the tightening of the clamp 9 to the side wall 14 places tension on the transverse rail 1. The purpose of the shield member 13 is to assist in certain instances in holding the module in place and to protect the head of the bolt from the abrasive action of the ore passing through the machine.

Figure 2:
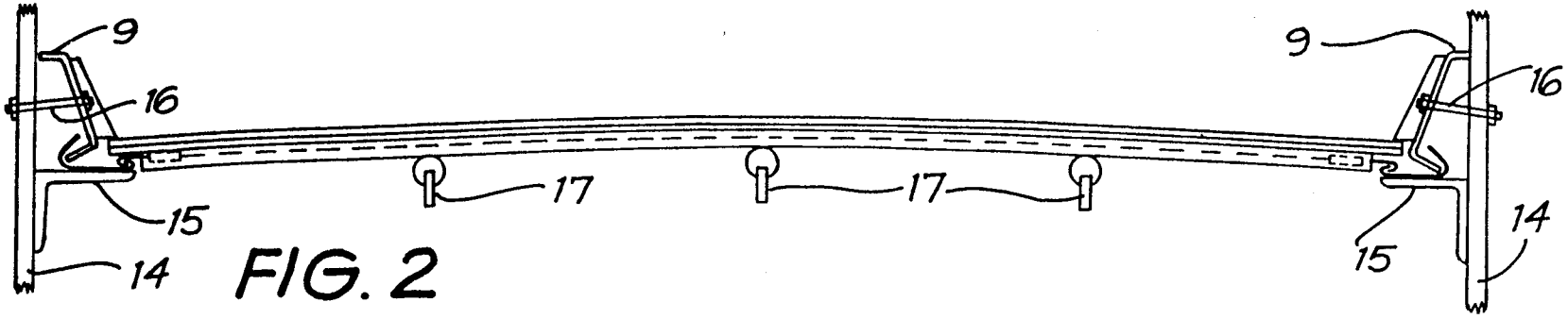
FIG. 2 is a similar view to FIG. 1 showing the transverse rail secured to each side wall of the box.
Figure 3:
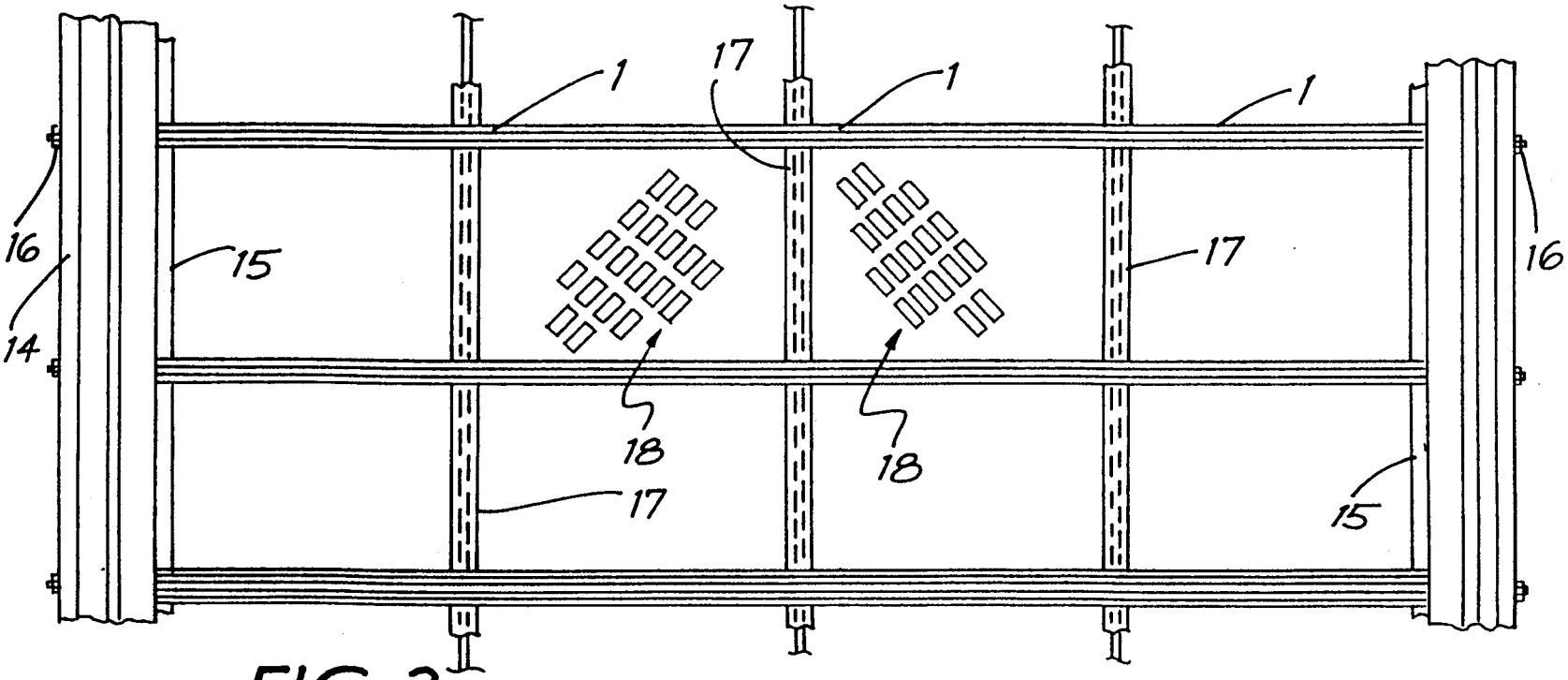
FIG. 3 is a plan view of FIG. 2 showing a number of transverse rails secured to each side wall of a screening machine.
Figures 4, 5:
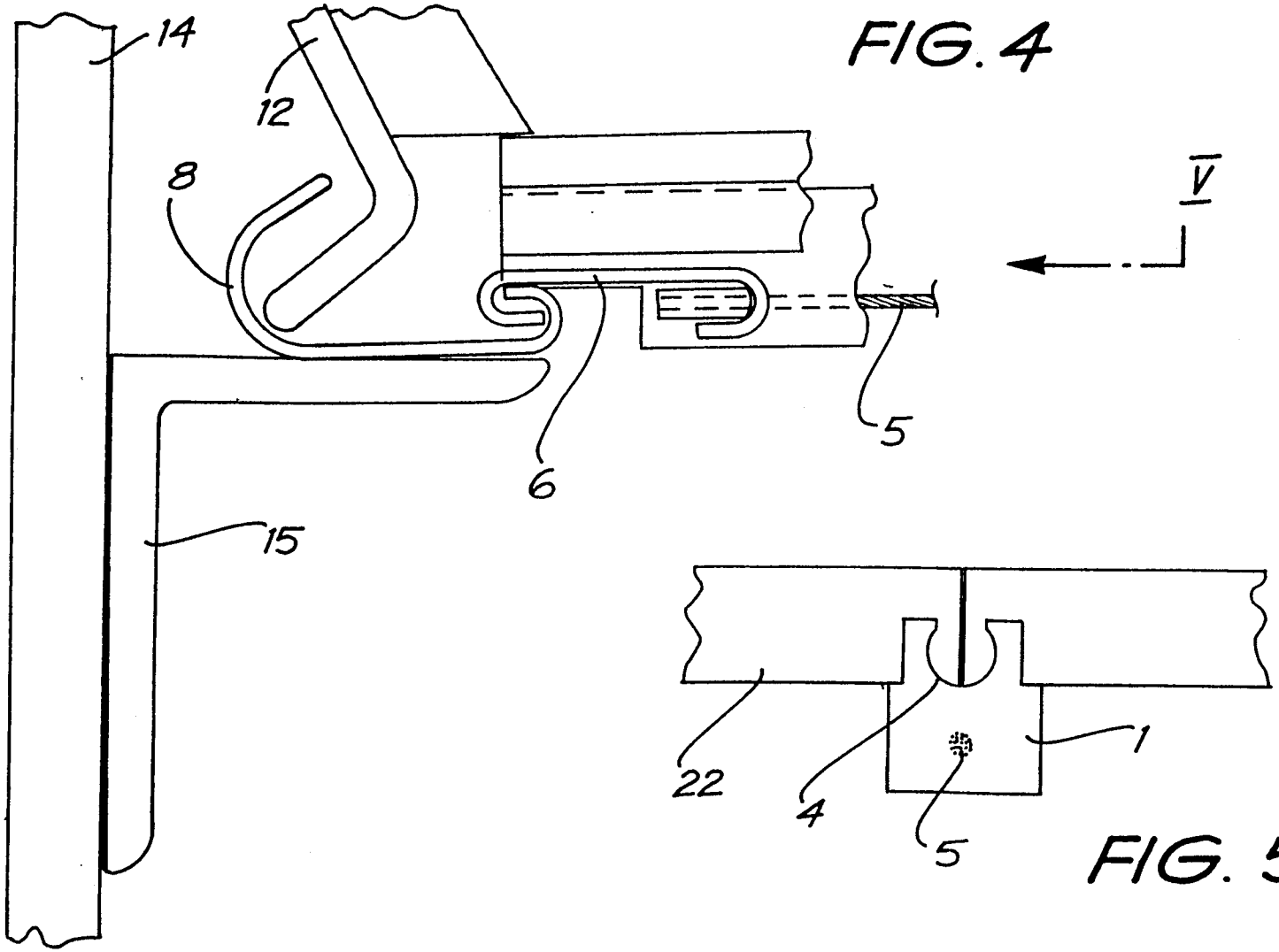
FIG. 4 is a part end view illustrating the tensioning arrangement for the transverse rails.
FIG. 5 is a section view on line V of FIG. 4.

As illustrated in FIGS. 2 and 3 the transverse rails are supported by longitudinal bucker bars 17 which with the transverse rails form a grid-like structure extending across the machine box and the spacing between the transverse rails is such as to accommodate and support a series of modules 18, which are interconnected to each other and to the transverse support rails to form a mat surface extending across the width of the machine box.

The modules (see FIG. 9) like the transverse rails are made of polyurethane. Each module has ends 19 and 20 and sides 21 and 22 defining the peripheral portion of the module. The module is conveniently formed in a moulding operation, the peripheral portion is provided with reinforcement preferably in the form of steel strips or bars 23 and 24 and in addition the module is provided with a plurality of openings formed by longitudinal members 25 and transverse members 26. These members may be provided with reinforcement in the form of reinforcing members embedded in the longitudinal members 25 and transverse members 26. The size of the openings will be selected to suit the particular reqiurements of the material to be screened.

Figure 9:
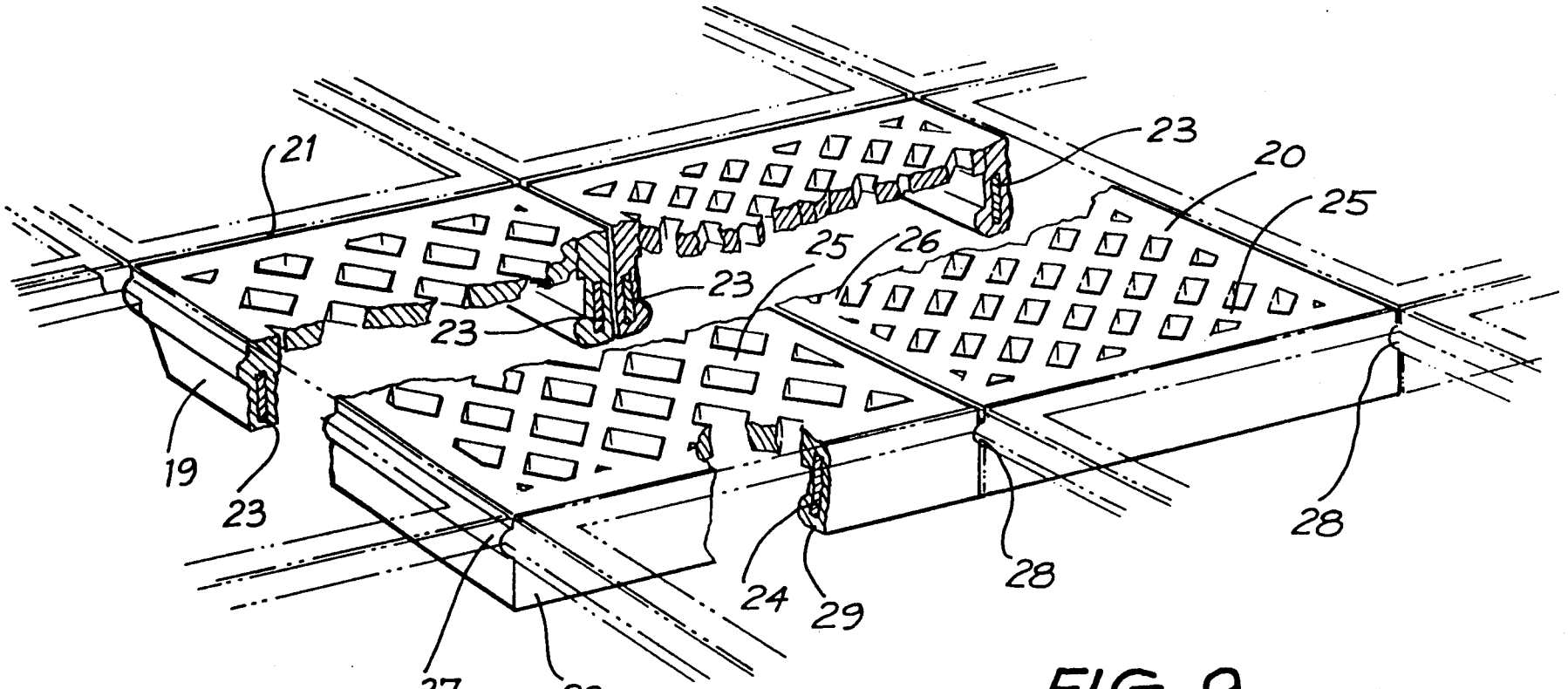
FIG. 9 is a perspective view of a screen module.

As illustrated in FIG. 9 adjoining modules are designed to interlock one with the other and to be firmly and accurately supported on the transverse rails 1. To this end each wall 19 is provided with a longitudinally extending protuberance 27 while the opposite end 20 is provided with a longitudinally extending channel 28 as clearly shown in FIG. 9. The channel 28 is so shaped and dimensioned so as to accurately accommodate the protuberance 27 of an adjoining module as illustrated in FIG. 9.

The inner faces of the walls 21 and 22 are each provided with a protuberance 29 which may extend throughout the length of the walls or only part way as circumstances dictate.

With the transverse rails 1 secured in the machine, the screening modules 1 are locked in position by locating the module on the rails 1 with the side walls 21 and 22 in register with the channel 4. The module is then pressed downwardly so that the side walls of the module enter the channel 4. Adjoining modules are positioned and locked in position in the same manner.

As will be apparent from FIG. 9 the protuberances 27 of each module snap into the channel 28 of an adjoining module. The interlocking of the adjoining modules and the locking of the respective modules to the transverse rail in the manner described ensures a tight fit. As no separate fastening means are used worn or damged modules may be removed and replaced in a matter of seconds.

Figure 6:
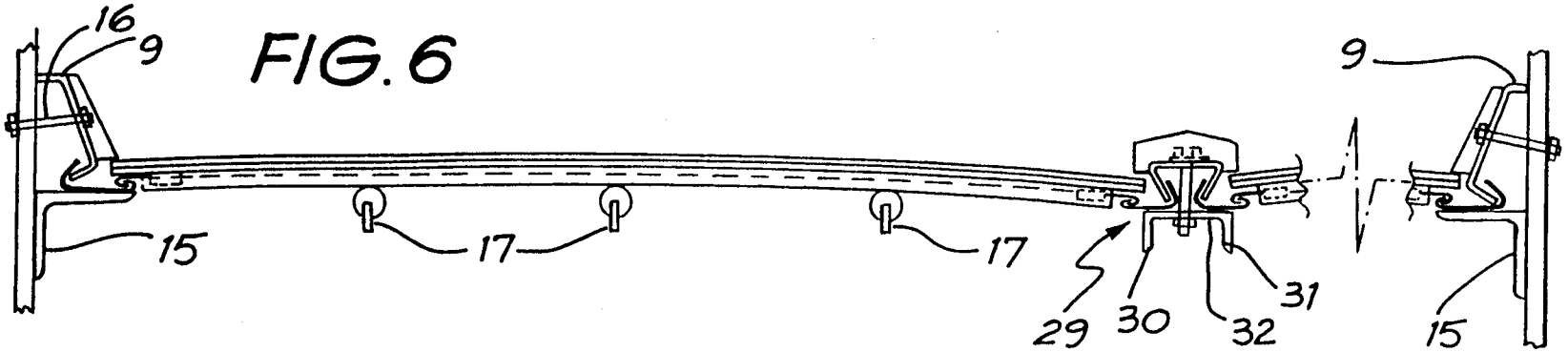
FIG. 6 is an end view illustrating the method of securing two transverse rails in end to end relationship across a screening machine box.
Figure 7:
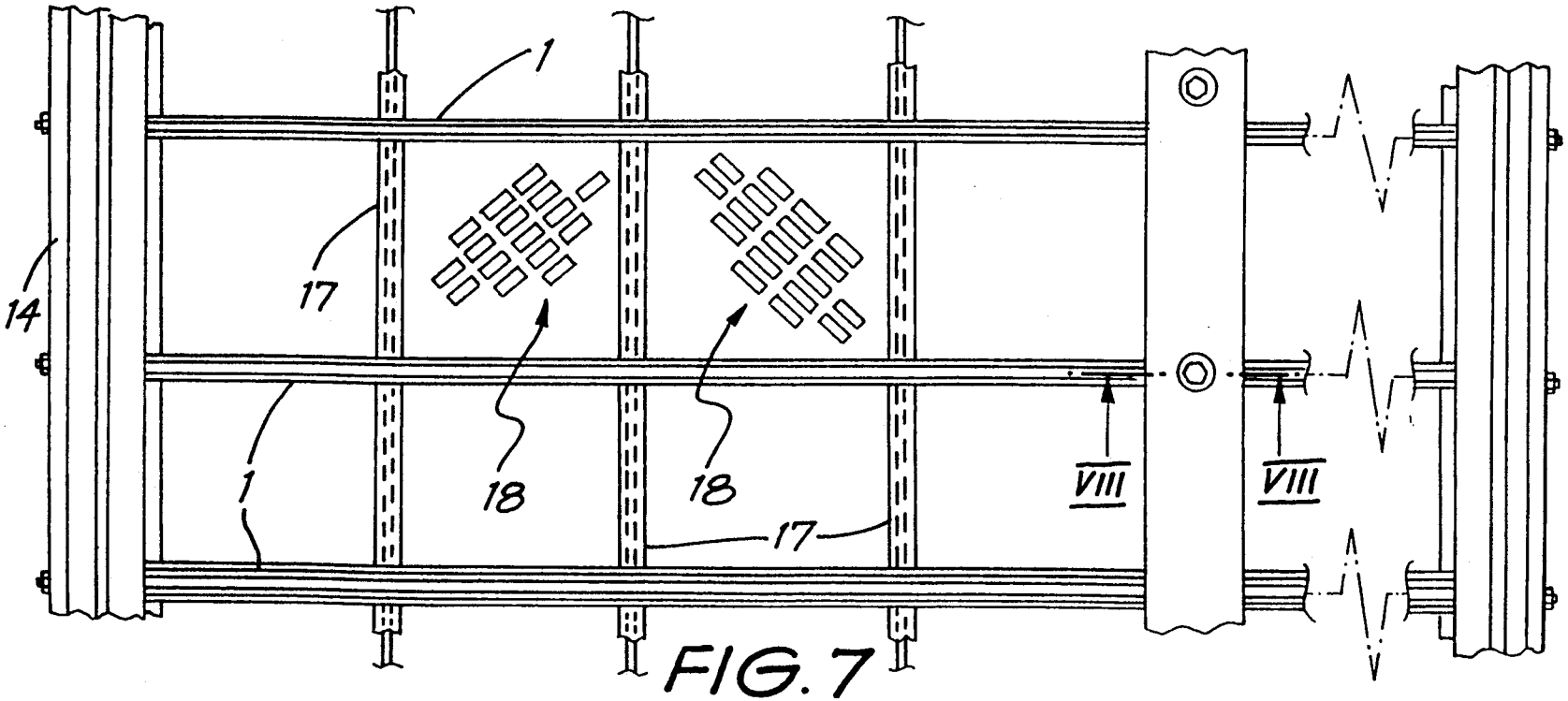
FIG. 7 is a plan view of FIG. 6.
Figure 8:
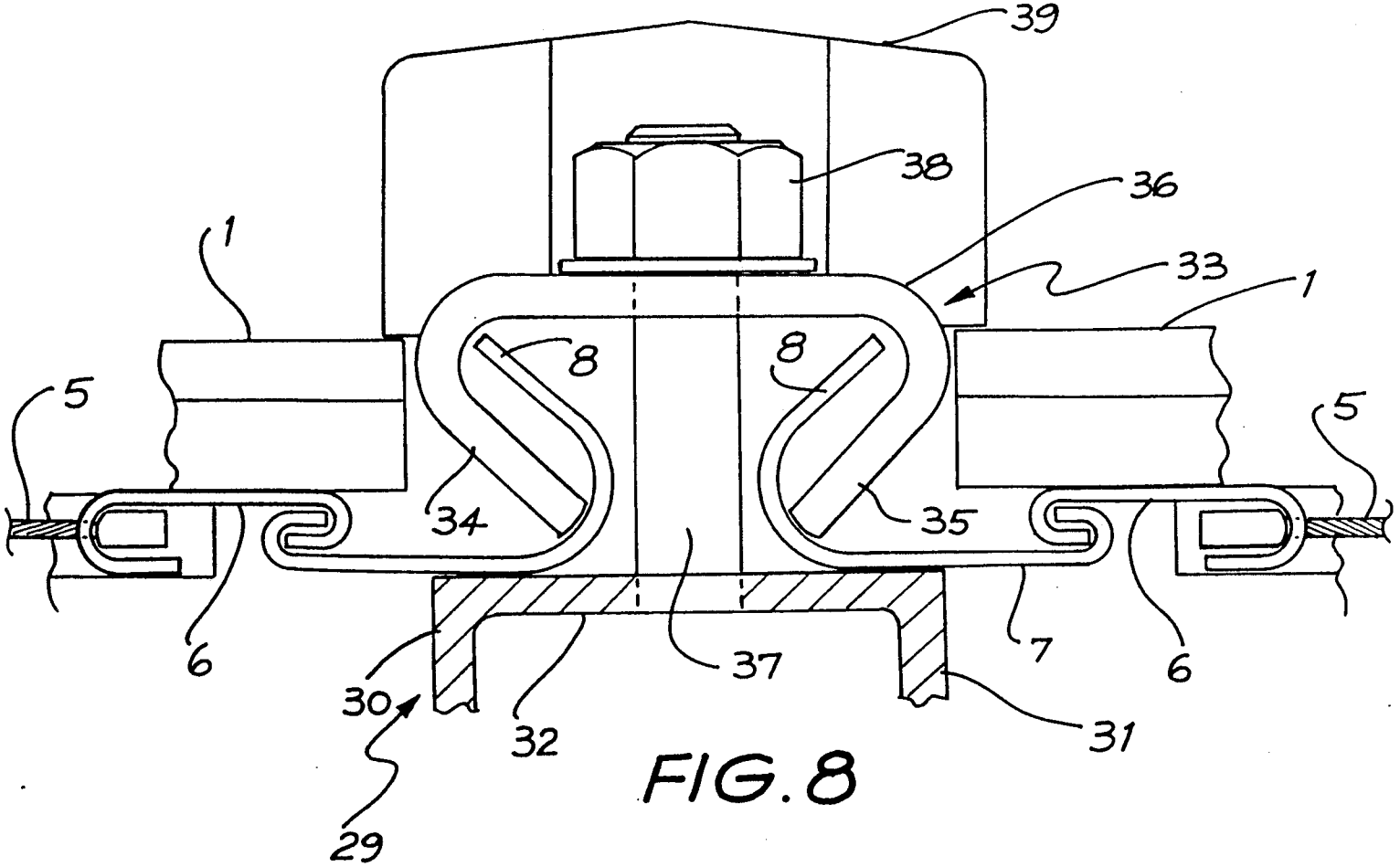
FIG. 8 is an end view on line 8—8 of FIG. 7.

FIGS. 6 and 7 illustates the case where the width of the machine box is such that it is not possible to have a single screen deck extending across the machine. In this case the same parts are identified by the same reference numerals however positioned centrally in the machine is a longitudinal support member 29 formed of a channel metal section having limbs 30 and 31 joined by a bight portion 32.

In this case the transverse rails in one half of the machine box are aligned with the transverse rails in the other half of the machine box with the respective hook members at one end of each transverse rail supported on the bight portion 32. A clamp 33 having limbs 34 and 35 joined by a bight portion 36 overlies the hook members 7 and couples the two transverse rails together. A stud 37 fixed to the bight portion 32 of the support bar 29 passes through a bore in the bight portion 36 and the clamp 33 is secured to the support bar 32 by a nut 38. A cover 39 is provided for the nut which serves the same purpose as the shield member 13.

Figure 10:
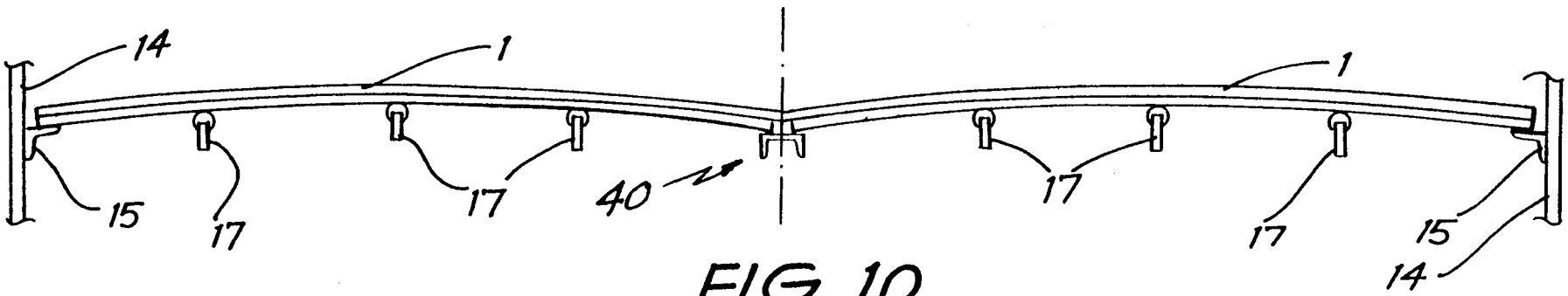
FIG. 10 is an end elevation illustrating an arrangement for supporting a double screen check.
Figure 11:
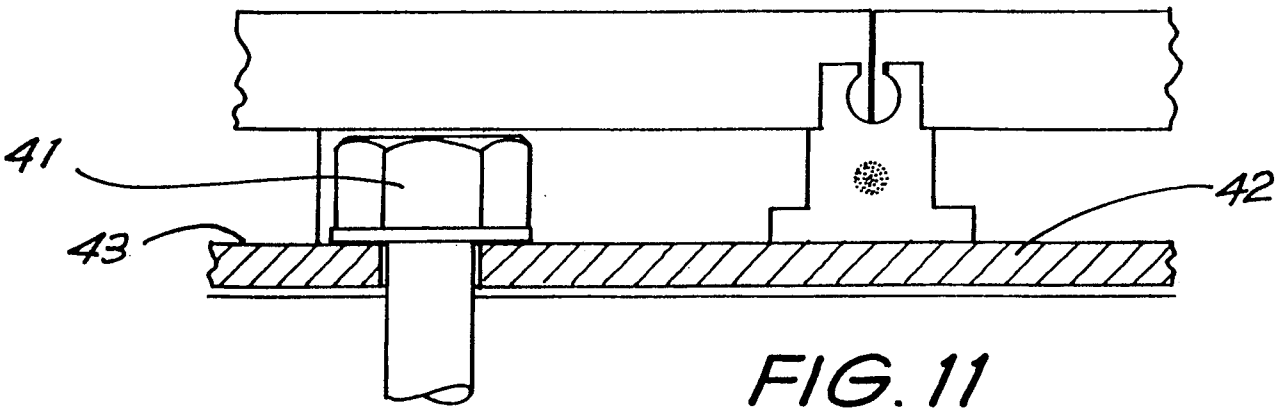
FIG. 11 is a sectional elevation of FIG. 10.
Figure 12:
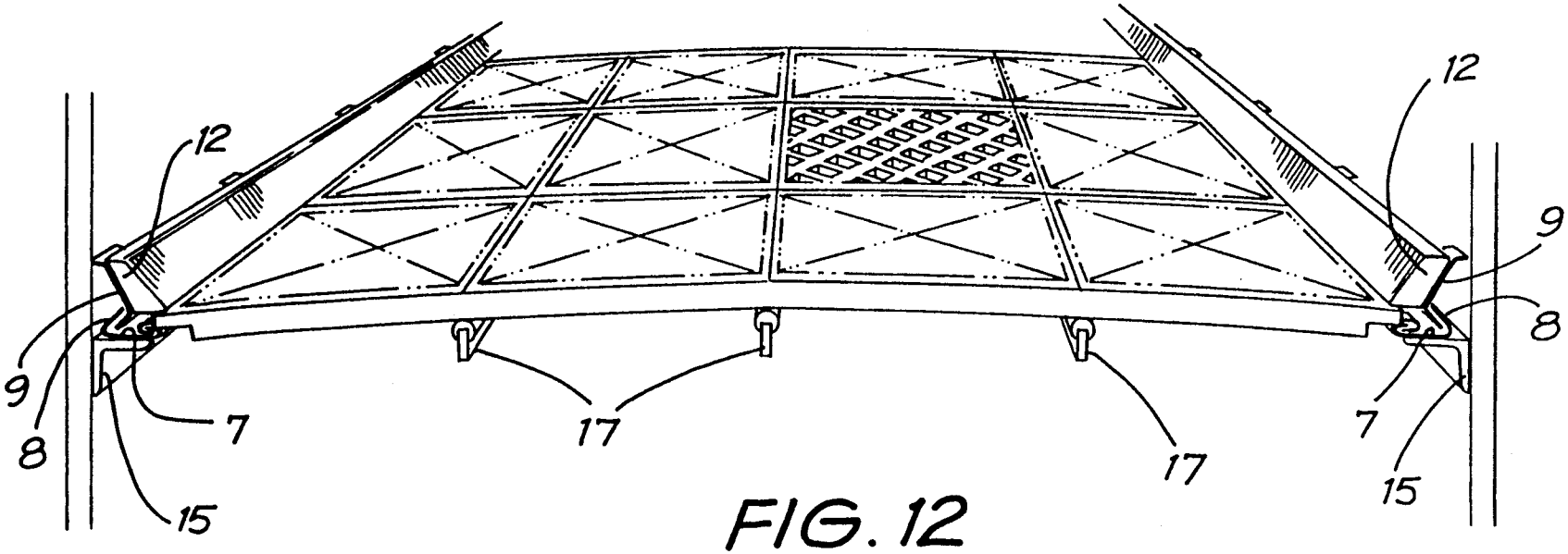
FIG. 12 is a perspective view of the embodiment illustrated in FIG. 1.

FIGS. 10 and 11 illustrate a modification where a double crown tension mat is used. As in the case of FIGS. 6 and 7 the same parts are identified by the same reference numerals.

In the case of this embodiment the transverse members extend across the width of the machine box as is the case with the FIG. 1 embodiment.

In the present case the transverse rails, in additon to being supported on the bucker bars 17, are clamped to a centrally positioned support member 40 by bolts 41 passing through flanges 42, 43 on the transverse rails 1. The flanges do not extend the length of the transverse rails but are only positioned on such rails in the area of the support member 40 so as not to constitute an obstacle to the free flow of aggregate passing through the mat.

I claim:

1. A screening machine including a screen box comprised of sidewalls and having longitudinal bucker bars spaced transversely therealong, transverse rails longitudinally spaced along the box and supported on the bucker bars, said transverse rails being formed of plastic material having a tension member embedded therein and extending throughout its length and which si fixed to a connecting member at each end thereof, said connecting member engaging with a hook member which interengages with a clamp member secured to said side walls of said box to tension the transverse rails across said box, the transverse rails defining with the bucker bars a grid like structure extending across said box, the transverse rails having a channel along the upper surface thereof co-operating with interengaging means on screen modules seated thereon to detachably secure a module to said transverse rails, said modules forming a screen mat extending across the box.

2. A screening machine as claimed in claim 1, wherein said connecting member is C-shaped, said hook member having a hook at each end, one end being locked to the connecting member, said hook member being seated on a bracket fixed to the side wall of the box and the other end of said hook member engaging one end of said clamp member which has a free second end seating against a side wall of the box, and a bolt passing through a bight portion of the clamp member and said side wall to secure the transverse member across said box.

3. A screening machine as claimed in claim 1, wherein said transverse rail comprises a body portion with a central rib upstanding therefrom, said channel extending through the length of an upper face of said rib, said rib extending beyond the body portion.

4. A screening machine as claimed in claim 1, wherein each module has a peripheral portion defined by side and end walls with a plurality of openings extending through said module inwardly of the said peripheral portion, the interengaging means of each module being provided as a protuberance on the side walls and adapted to enter into a channel in each transverse member to lock said module thereto, one end wall of each module being provided with a longitudinally extending protuberance and the other end wall being provided with a longitudinal extending channel, the longitudinally extending protuberance of one module being a snap fit in the channel of an adjoining module to interlock the modules together.

5. A screening machine including a screen box having side walls, said box having a support member extending longitudinally along said box with longitudinally extending bucker bars transversely spaced along the box on either side of the support member, transverse rails longitudinally spaced along said box on either side of said support member and supported by said bucker bars, the transverse rails on one side of the support member being aligned with the transverse rails on the other side of said support member, said transverse rails being formed of plastic material having a tensioning member embedded therein and extending throughout its length and which is fixed to a connecting member at each end thereof, said connecting member interengaging with a hook member which engages with a clamp member secured to the side walls of said box and to said support member, respectively, to tension said rails across said box between the side walls of said box and said support member, the transverse rails defining with the bucker bars grid like structure extending across said box, the transverse rails having a channel extending along the upper surface thereof and co-operating with interengaging means on screen modules seated thereon to detachably secure said module to said transverse rails, said modules forming a screen mat extending across the box.

6. A screening machine as claimed in claim 5, wherein the connecting member is C-shaped, said hook member having a hook at each end, one end of said hook being locked to the connecting member and the other end of said hook engaging one end of said clamp member, the hook member at one end of said transverse member being seated on a bracket fixed to a side wall of the box and a free second end of said clamp member being seated against the side wall of said box, the hook member at the other end of said transverse member being seated on said support member with the free ends of adjoining hook members engaging said member with bolts passing through the respective clamp members at either end of the transverse member and the underlying wall and support member to apply tension to said transverse member.

7. A screening machine as claimed in claim 5, wherein aid transverse rails comprises a body portion with a central rib upstanding therefrom, said channel extending throughout the length of an upper face of said rib, said rib extending beyond the body portion.

8. A screening machine as claimed in claim 5, wherein each module has a peripheral portion defined by side and end walls with a plurality of openings extending through said module inwardly of the said peripheral portion, the interengaging means of each module being provided as a protuberance on the side walls and adapted to enter into a channel in each transverse member to lock said module thereto, one end wall of each module being provided with a longitudinally extending protuberance and the other end wall being provided with a longitudinally extending channel, a longitudinally extending protuberance of one module being a snap fit in the channel of an adjoining module to interlock the module together.

* * * * *